US009702110B1

(12) United States Patent
Hilfiker et al.

(10) Patent No.: US 9,702,110 B1
(45) Date of Patent: Jul. 11, 2017

(54) PANEL CONNECTOR AND METHOD OF USE

(76) Inventors: William K. Hilfiker, Eureka, CA (US); William B. Hilfiker, Fortuna, CA (US); Harold K. Hilfiker, Eureka, CA (US)

( * ) Notice: Subject to any disclaimer, the term of this patent is extended or adjusted under 35 U.S.C. 154(b) by 707 days.

(21) Appl. No.: 13/585,400

(22) Filed: Aug. 14, 2012

(51) Int. Cl.
*E02D 29/00* (2006.01)
*E02D 29/02* (2006.01)

(52) U.S. Cl.
CPC ..... *E02D 29/02* (2013.01)

(58) Field of Classification Search
USPC ..... 24/116 A
See application file for complete search history.

(56) References Cited

U.S. PATENT DOCUMENTS

| | | | | | |
|---|---|---|---|---|---|
| 1,380,244 | A * | 5/1921 | Otis | 24/576.1 |
| 1,419,644 | A * | 6/1922 | Recker | 174/138 B |
| 1,521,619 | A * | 1/1925 | Haas | 24/116 A |
| 2,872,716 | A | 2/1959 | Ehmann et. al. | |
| 4,054,033 | A * | 10/1977 | Pillosio | 405/282 |
| 4,198,020 | A * | 4/1980 | Walker et al. | 248/154 |
| 4,366,850 | A * | 1/1983 | Coutts | 152/222 |
| 4,929,125 | A | 5/1990 | Hilfiker | |
| 4,993,879 | A * | 2/1991 | Hilfiker | 405/262 |
| 5,044,833 | A * | 9/1991 | Wilfiker | 405/267 |
| 5,409,330 | A * | 4/1995 | Naines et al. | 403/292 |
| 7,124,477 | B2 * | 10/2006 | Boland | 24/116 A |
| 8,079,782 | B1 * | 12/2011 | Hilfiker et al. | 405/262 |
| 8,393,829 | B2 * | 3/2013 | Taylor | 405/262 |
| 2011/0229274 | A1 * | 9/2011 | Taylor | 405/262 |

* cited by examiner

*Primary Examiner* — Thomas B Will
*Assistant Examiner* — Katherine Chu
(74) *Attorney, Agent, or Firm* — Eric Karich; Karich & Associates

(57) ABSTRACT

A panel connector has a connection body for connecting with a soil reinforcement rod, and an anchor for connecting the connection body to a concrete face panel. The connection body defines a socket shaped to receive and engage the head of the soil reinforcement rod. The socket includes an insertion aperture having an aperture diameter greater than a head diameter of the head of the soil reinforcement rod, a base having an exit aperture with an exit diameter smaller than the head diameter, and a side slot extending from the insertion aperture to the exit aperture.

7 Claims, 5 Drawing Sheets

PANEL CONNECTOR AND METHOD OF USE

BACKGROUND OF THE INVENTION

Field of the Invention

This invention relates generally to retaining walls, and more particularly to a panel connector for connecting a soil reinforcement rod with a concrete face panel.

Description of Related Art

The prior art teaches many mechanisms and structures for attaching soil reinforcement rods to concrete face panels.

Hilfiker, U.S. Pat. No. 4,929,125, for example, teaches implanting loops or "eyes" in the concrete of the face panel for connecting them to the soil reinforcement rods. Each of the rods terminates in a loop that may be attached to the loop of the concrete face panel. This connector not only secures the soil reinforcement rods to the concrete face panels, it also serves to orient the soil reinforcement rods in a horizontal disposition within the embankment.

In another example, Hilfiker, U.S. Pat. No. 4,993,879, teaches another form of connectors for securing soil reinforcement elements to concrete face panels. The connectors include eyes fixed within the concrete face panels, and a wire lattice that is attached to the eyes with a rod that extends through the wire lattice and each of the eyes.

The prior art teaches various forms of connectors for connecting soil reinforcement rods to concrete face panels. However, the prior art does not teach connectors such as are described herein. The present invention fulfills these needs and provides further advantages as described in the following summary.

SUMMARY OF THE INVENTION

The present invention teaches certain benefits in construction and use which give rise to the objectives described below.

The present invention provides a panel connector for connecting a head of a soil reinforcement rod with a concrete face panel. The panel connector comprises a connection body for connecting with the soil reinforcement rod. The connection body defines a socket shaped to receive and engage the head of the soil reinforcement rod. The socket includes an insertion aperture having an aperture diameter greater than a head diameter of the head of the soil reinforcement rod, a base having an exit aperture with an exit diameter smaller than the head diameter, and a side slot extending from the insertion aperture to the exit aperture. The side slot has a slot width that is larger than a width of the soil reinforcement rod but smaller than the head diameter. The panel connector further includes an anchor extending from the connection body shaped to engage the concrete face panel.

A primary objective of the present invention is to provide a panel connector and a soil reinforcement system having advantages not taught by the prior art.

Another objective is to provide a panel connector that is quick and easy to install.

A further objective is to provide a soil reinforcement system that provides superior performance to the prior art.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
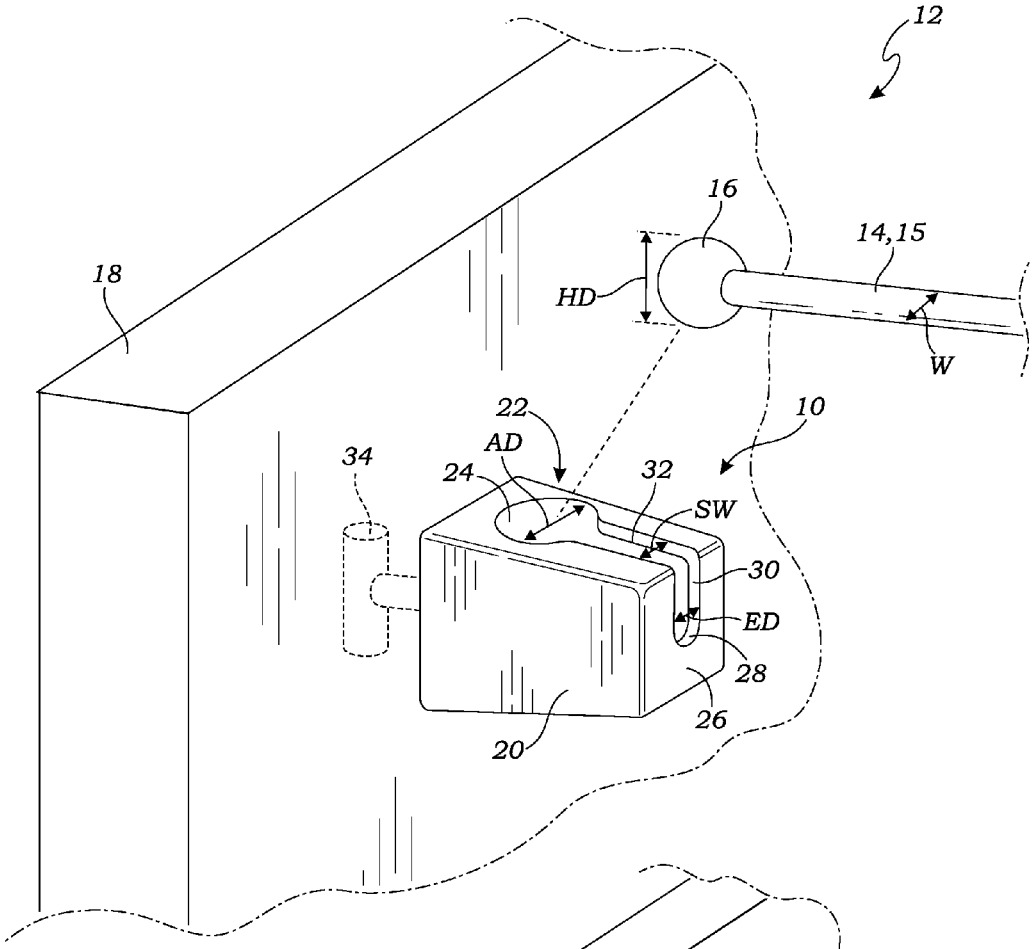
FIG. 1 is an exploded perspective view of a first embodiment of a soil reinforcement system, illustrating a soil reinforcement rod attached to a concrete face panel with a panel connector.

The above-described drawing figures illustrate the invention, a panel connector 10 for connecting a head 16 of a soil reinforcement rod 14 with a concrete face panel 18. The panel connector 10 is part of a soil reinforcement system 12 that is discussed in greater detail below.

Figure 2:
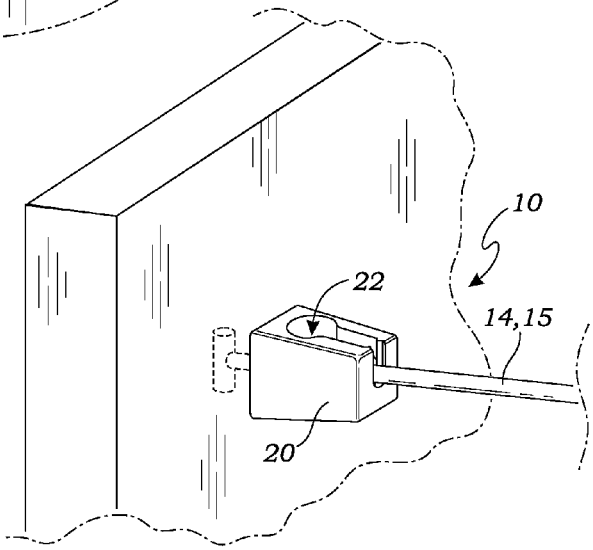
FIG. 2 is a perspective view thereof, illustrating the soil reinforcement rod operably positioned within the panel connector.
Figure 3:
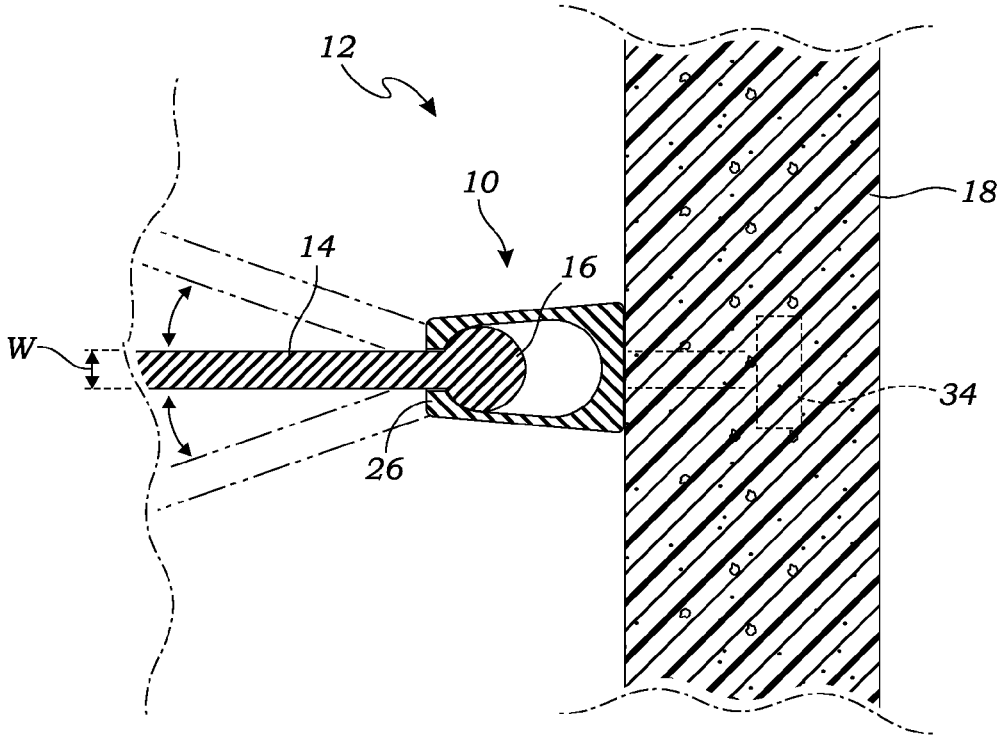
FIG. 3 is a top plan view thereof.
Figure 4:
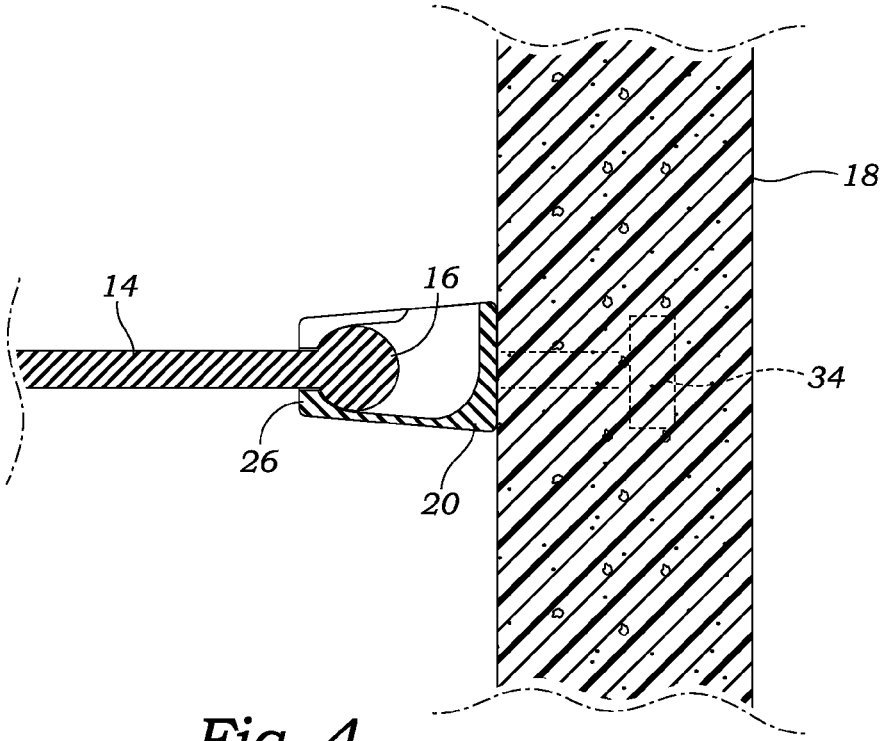
FIG. 4 is a side elevational view thereof.

FIG. 1 is an exploded perspective view of a first embodiment of the soil reinforcement system 12. FIG. 2 is a perspective view thereof, illustrating the soil reinforcement rod 14 operably positioned within the panel connector 10. FIG. 3 is a top plan view thereof, and FIG. 4 is a side elevational view thereof.

As shown in FIGS. 1-4, the panel connector 10 includes a connection body 20 and an anchor 34. The connection body 20 is shaped for connecting with the soil reinforcement rod 14. In this embodiment, the connection body 20 defines a socket 22 shaped to receive and engage the head 16 of the soil reinforcement rod 14. The socket 22 including an insertion aperture 24, a base 26, and a side slot 32. The insertion aperture 24 has an aperture diameter AD greater than a head diameter HD of the head 16 of the soil reinforcement rod 14, so that the head 16 may be inserted through the insertion aperture 24 into the socket 22.

The base 26 has an exit aperture 28 with an exit diameter ED smaller than the head diameter HD, but larger than a width W of the soil reinforcement rod 14. The side slot 32 extends from the insertion aperture 24 to the exit aperture 28. The side slot 32 having a slot width SW that is larger than a width W of the soil reinforcement rod 14 but smaller than the head diameter HD. During installation of the soil reinforcement system 12, the head 16 of the soil reinforcement rod 14 may be inserted through the insertion aperture 24 so that the soil reinforcement rod 14 extends out the exit aperture 28. The soil reinforcement rod 14 may then be pulled away from the concrete face panel 18, so that the head 16 is firmly seated in the socket 22. In this embodiment, the base 26 includes a lip that extends inwardly to allow the head 16 to seat firmly against the base 26 but not slip out of the exit aperture 28.

The anchor 34 extends from the connection body 20 shaped to engage the concrete face panel 18. In the embodiment of FIGS. 1-4, the anchor 34 is a protrusion, in this case a T-shaped element 34 that extends from the connection body 20. During the formation of the concrete face panel 18, the connection body 20 is positioned on the concrete face panel 18 while it is still soft, so that when the concrete cures, the connection body 20 if fixed in place. While one shape is illustrated, alternative or equivalent shapes or structures may be used. Furthermore, while embedding the anchor 34 into the concrete of the concrete face panel 18 is used in one embodiment, the connection body 20 may be attached to the concrete face panel 18 in alternative or equivalent ways, and such alternatives should be considered within the scope of the present invention.

Figure 5:
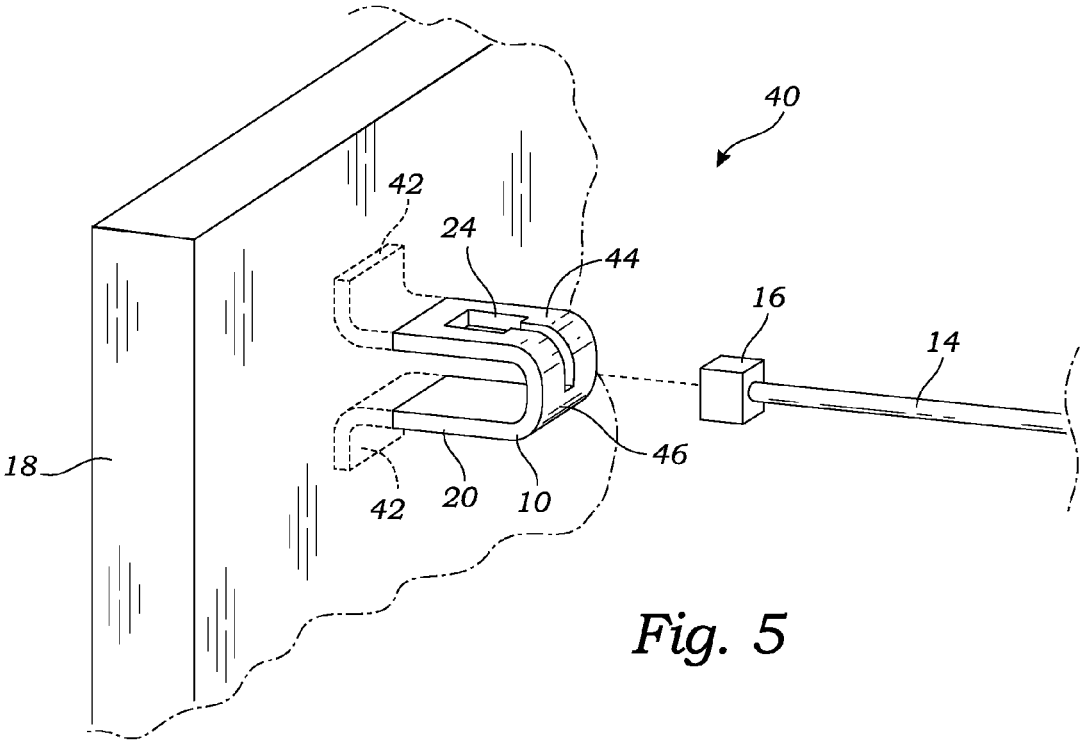
FIG. 5 is an exploded perspective view of a second embodiment of the panel connector.
Figure 6:
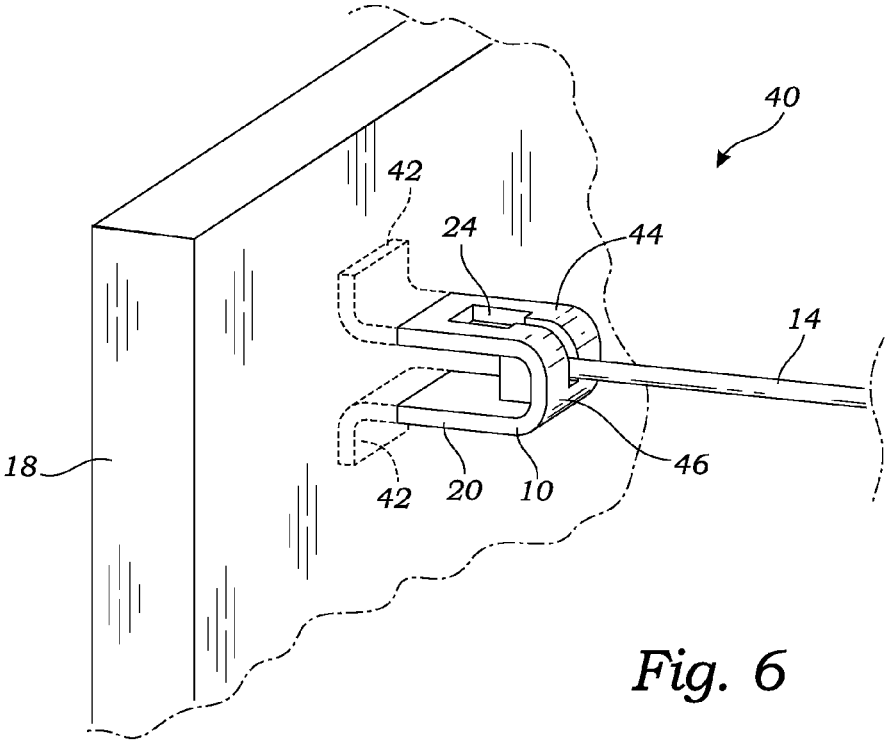
FIG. 6 is a perspective view thereof.
Figure 7:
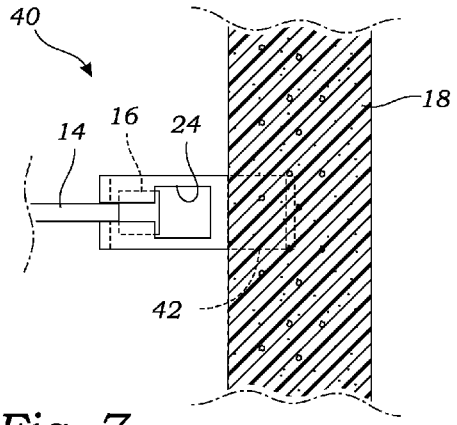
FIG. 7 is a top plan view thereof.
Figure 8:
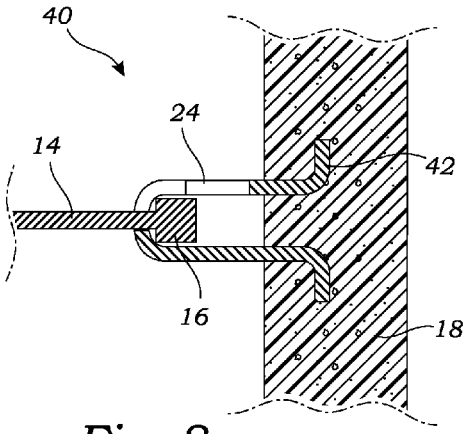
FIG. 8 is a side elevational view thereof.

FIG. 5 is an exploded perspective view of a second embodiment of the panel connector 40. FIG. 6 is a perspective view thereof, FIG. 7 is a top plan view thereof, and FIG. 8 is a side elevational view thereof. As illustrated in FIGS. 5-8, the second embodiment of the panel connector 40 is generally U-shaped, extending to two outwardly extending flanges 42 that provide the anchor that may be set into the concrete of the concrete face panel 18. In the embodiment of FIGS. 5-8, the insertion aperture 24 is formed on a side 44 of the panel connector 40, and the slot extends to a bottom portion 46.

Figure 9:
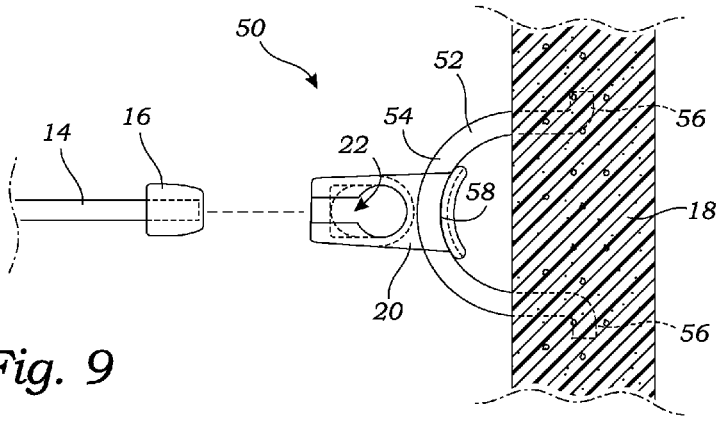
FIG. 9 is a side elevational view of a third embodiment of the panel connector.
Figure 10:
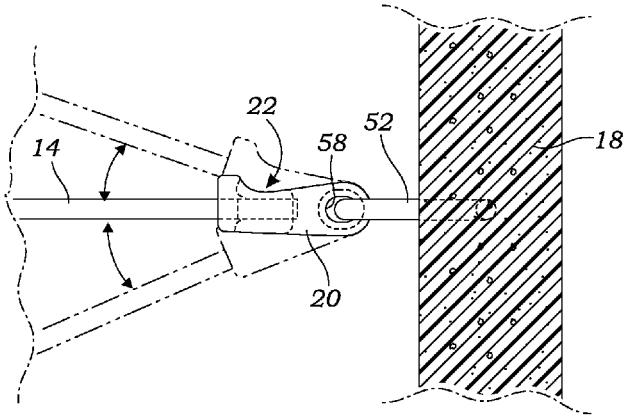
FIG. 10 a top plan view thereof.

FIG. 9 is a side elevational view of a third embodiment of the panel connector 50, and FIG. 10 a top plan view thereof. In the embodiment of FIGS. 9-10, an anchor loop 52 provides the anchor discussed above, and the panel connector 50 is pivotally connected to the anchor loop 52 to enable a greater degree of movement of the soil reinforcement rod 14. The anchor loop 52 of this embodiment includes a median portion 54 that extends to two ends 56, and is adapted to be installed in the concrete face panel 18 such that the two ends 56 are embedded in the concrete and the median portion 54 forms a loop extending from the concrete.

The connection body 20 includes a head engagement socket 22 such as is described above, and a loop engagement feature 58 that is shaped to engage the anchor loop 52 for engaging the panel connector 10 with the concrete face panel 18. In the embodiment of FIGS. 9-10, the loop engagement feature 58 is a laterally extending conduit that is shaped to receive the median portion 54 of the anchor loop 52 therethrough, in a manner that allows the connection body 20 to pivot with respect to the anchor loop 52. While one embodiment of these features is illustrated herein, those skilled in the art may devise similar or equivalent constructions, and these alternative construction should be considered within the scope of the present invention.

Figure 11:
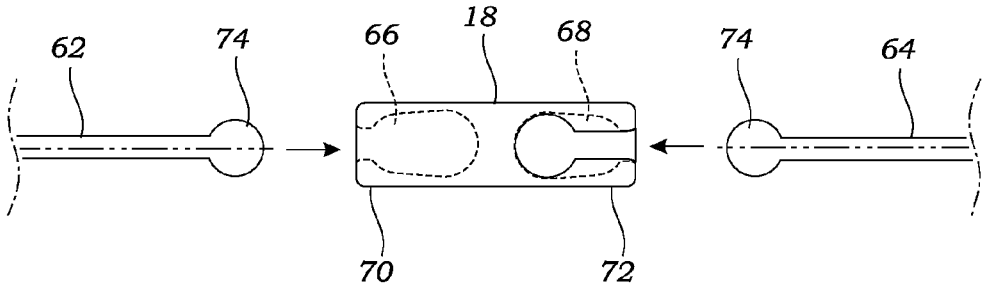
FIG. 11 is an exploded top plan view of a coupling element used to connect first and second soil reinforcement rods.

FIG. 11 is an exploded top plan view of a coupling element 60 used to connect first and second soil reinforcement rods 62 and 64. In this embodiment, the coupling element 60 includes two head engagement sockets 66 and 68, one at a first end 70 and the other at an opposed second end 72. Heads of the first and second soil reinforcement rods 62 and 64 may be engaged with the head engagement sockets 66 and 68 in the manner described above. In this manner, the first and second soil reinforcement rods 62 and 64 may be daisy chained together to adjust the total rod length in the soil reinforcement system 12.

The soil reinforcement rod 14 includes an elongate body 15 extends to the head 16, as discussed above. In production, the head 16 of the soil reinforcement rod 14 may be cold formed on the end of the elongate body 15. An example of such a product is illustrated in FIG. 1. The head 16 could alternatively be swaged on, as illustrated in FIG. 9. The head 16 may alternatively be threadedly engaged with the rod 14, welded onto the rod 14, or formed in any other manner known to those skilled in the art. Furthermore, it is worth noting that the head 16 may be formed in any shape (e.g., round, square, hex, etc.) that will fit the panel connector. While certain specific shapes are illustrated, alternative shapes and configurations are also within the scope of the present invention.

Figure 12:
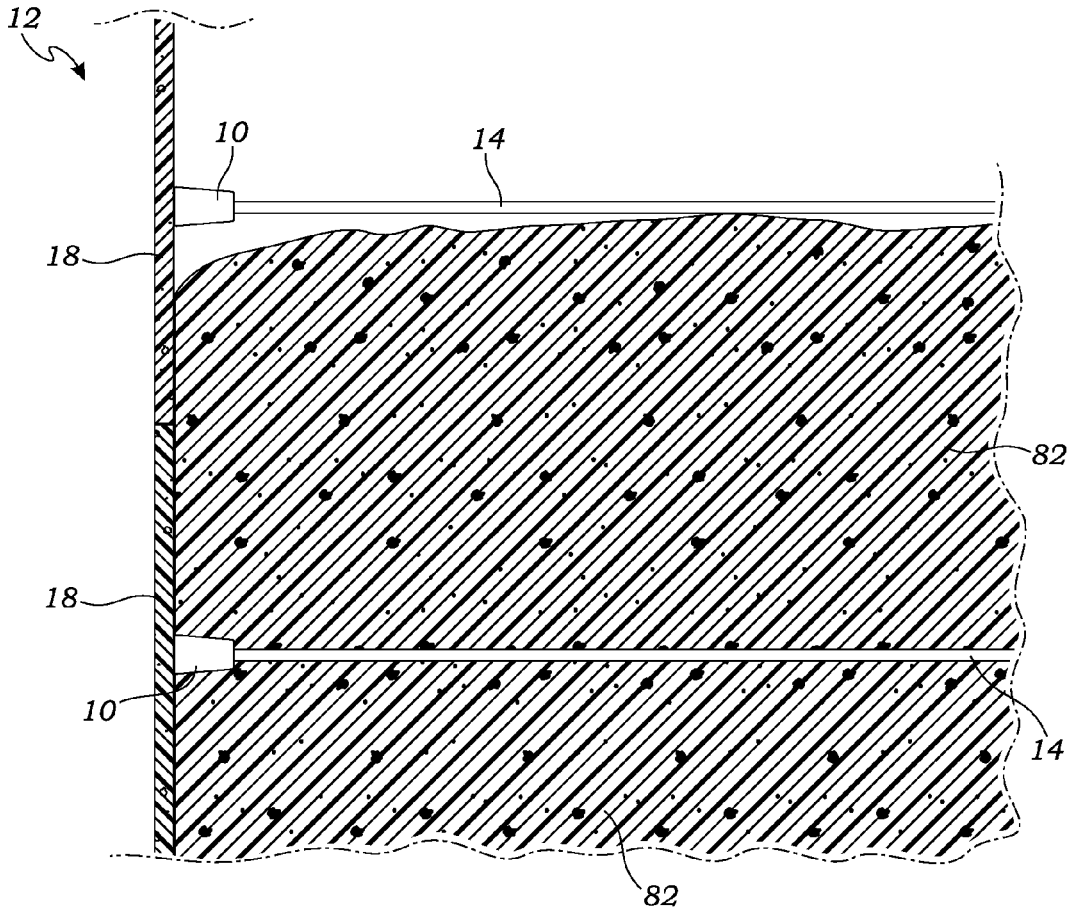
FIG. 12 is a side elevational sectional view of an earthen embankment having the soil reinforcement system installed therein.

The invention also includes a method for supporting an earthen embankment 80 using the soil reinforcement system 12 described above. FIG. 12 is a side elevational sectional view of an earthen embankment 80 having the soil reinforcement system 12 installed therein. As illustrated in FIG. 12, in this method, the panel connectors 10 are anchored to the concrete face panel 18 as shown and described above. The concrete face panel 18 is positioned to support the earthen embankment 80, using techniques known in the art.

The soil reinforcement rods 14 are positioned over, or otherwise positioned within the earthen embankment 80, using techniques known in the art. In this embodiment, the head 16 of each of the soil reinforcement rods 14 is inserted into the insertion aperture 24 of one of the panel connectors 10 such that the soil reinforcement rod 14 extends from the exit aperture 28, and each of the soil reinforcement rods 14 is then pulled so that the head 16 of each of the soil reinforcement rods 14 is firmly engaged with the socket 22.

The soil reinforcement rods 14 may then be covered with additional earth and compacted during the formation of the earthen embankment 80, and additional soil reinforcement rods 14 added, using techniques known in the art. Since the construction of earthen embankments 80 and, generally, the construction of retaining walls, is well known, additional details of such construction are not provided herein.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A soil reinforcement system for anchoring a concrete face panel, the soil reinforcement system comprising:

a soil reinforcement rod having an elongate body with a head formed on a proximal end thereof, the soil reinforcement rod having a width, and the head having a head diameter that is greater than the width of the soil reinforcement rod; and a panel connector comprising:

a connection body for connecting with the soil reinforcement rod, the connection body defining a socket shaped to receive and engage the head of the soil reinforcement rod, the socket including an insertion aperture having an aperture diameter greater than the head diameter of the head of the soil reinforcement rod, a base having an exit aperture with an exit diameter smaller than the head diameter, and a side slot extending from the insertion aperture to the exit aperture, the side slot having a slot width that is larger than the width of the soil reinforcement rod but smaller than the head diameter, such that the head engages the connection body in a ball-and-socket configuration that allows a pivotal movement of the soil reinforcement rod with respect to the connection body; and an anchor extending from the connection body opposite the exit aperture and shaped to fit within and engage the concrete face panel once the concrete face panel has cured, and wherein the anchor includes a T-shaped body.

2. The soil reinforcement system of claim 1, wherein the anchor is an anchor loop having a median portion that extends to two ends, and wherein the connection body includes a loop engagement feature that is shaped to pivotally receive the anchor loop.

3. The soil reinforcement system of claim 2, wherein the loop engagement feature is a laterally extending conduit that is shaped to receive the median portion of the anchor loop therethrough, in a manner that allows the connection body to pivot with respect to the anchor loop.

4. The soil reinforcement system of claim 1, wherein the head of the soil reinforcement rod is cold formed from the elongate body of the soil reinforcement rod.

5. The soil reinforcement system of claim 1, wherein the head of the soil reinforcement rod is welded to the elongate body of the soil reinforcement rod.

6. The soil reinforcement system of claim 1, wherein the head of the soil reinforcement rod is swaged to the elongate body of the soil reinforcement rod.

7. The soil reinforcement system of claim 1, wherein the head of the soil reinforcement rod is threadedly engaged with the elongate body of the soil reinforcement rod.

* * * * *